US008683730B1

(12) United States Patent
Moore

(10) Patent No.: US 8,683,730 B1
(45) Date of Patent: Apr. 1, 2014

(54) RIFLE REST

(71) Applicant: William Michael Moore, Wickenburg, AZ (US)

(72) Inventor: William Michael Moore, Wickenburg, AZ (US)

( * ) Notice: Subject to any disclaimer, the term of this patent is extended or adjusted under 35 U.S.C. 154(b) by 0 days.

(21) Appl. No.: 13/986,158

(22) Filed: Apr. 6, 2013

Related U.S. Application Data

(60) Provisional application No. 61/689,177, filed on May 30, 2012.

(51) Int. Cl.
*F41A 31/00* (2006.01)
*F41A 23/16* (2006.01)

(52) U.S. Cl.
CPC ..... *F41A 23/16* (2013.01)
USPC ..... 42/94

(58) Field of Classification Search
USPC ..... 42/94; 211/64; 73/167; 89/37.04, 37.03; D22/108
See application file for complete search history.

(56) References Cited

U.S. PATENT DOCUMENTS

| | | | | |
|---|---|---|---|---|
| D203,680 | S * | 2/1966 | Allison | D22/108 |
| 4,409,751 | A | 10/1983 | Goda et al. | |
| 4,924,616 | A * | 5/1990 | Bell | 42/94 |
| D387,123 | S | 12/1997 | Hughes et al. | |
| 6,931,777 | B1 * | 8/2005 | Krien | 42/94 |
| D519,183 | S | 4/2006 | Minneman | |
| 7,356,960 | B1 * | 4/2008 | Knitt | 42/94 |
| 7,774,972 | B2 | 8/2010 | Potterfield et al. | |
| 7,997,021 | B2 * | 8/2011 | Cauley et al. | 42/94 |
| 8,006,426 | B1 * | 8/2011 | Carroll | 42/94 |
| 8,132,351 | B2 | 3/2012 | Potterfield et al. | |
| 2013/0086835 | A1 * | 4/2013 | Minneman | 42/94 |

* cited by examiner

*Primary Examiner* — Reginald Tillman, Jr.

(57) ABSTRACT

A rifle rest structure is adapted to receive first and second sand bags and operative to place a rifle thereon for target practice or the like. The rifle rest has a unitary frame construction including a front portion that supports the front of a rifle, a rear portion that supports the rear of the rifle, and a middle portion that rigidly interconnects the front and rear portions. The front portion has a length that is longer than a parallel length of the rear portion. The length of the front portion is in the range of six times longer than the parallel rear portion. The rifle rest further includes an adjusting mechanism that is operative to adjust the elevation of the front portion relative to the rear portion. The subject arrangement provides good stability for the rifle during use.

16 Claims, 4 Drawing Sheets

RIFLE REST

TECHNICAL FIELD

The subject concept relates generally to a rest for use to hold a weapon, such as a rifle, during target practice and the like and more specifically relates to a unitary, stable rifle rest that is easy to use, sturdy in construction and has a limited number of moving parts.

BACKGROUND

Various known rifle supports have numerous moving parts and are made of light weight metal materials and/or plastic materials. Other known rifle supports do not allow the user to hold the rifle against his shoulder during use since the butt end is secured on the support mechanism. Still other known rifle support mechanisms use a single point of contact at the end thereof where the butt of the rifle rests. This single point of contact does not provide much resistance to movement of the support mechanism during shooting of the rifle. It is desirable for the user to be able to rest the rifle on the rifle rest while holding the rifle against his shoulder in a normal manner and fire the rifle at a target or the like with great accuracy and to be able to fire repeated rounds at the target without having to take a lot of time and effort to re-aim the rifle. Likewise it is desirable to readily pick up the rifle rest, without major effort, and move it to a different location.

SUMMARY OF THE INVENTION

According to the present concept, a rifle rest is provided that is made substantially of a unitary design having limited moving parts and is a mobile design that can be moved from place to place without requiring major physical efforts. The subject concept has a front portion, a mid portion, and a rear portion each rigidly attached to each other. The front portion has a bag receiving portion spaced upward from a bottom thereof a predetermined distance and positioned generally central of the front portion. An adjustment mechanism is disposed on outer portions of the front portion and adapted to permit vertical adjustment of the front portion relative to the surface that it rests upon. The mid portion has a width of a predetermined size and shape. The rear portion has a bag receiving portion spaced upward from a bottom thereof at a predetermined distance less than the predetermined distance of the bag receiving portion of the front portion. The rear portion has a bottom edge portion having a predetermined width extending parallel to the front portion and being of a width at least the width of the mid portion thereof.

The construction of the subject rifle rest provides a more stable rifle rest having limited movement during target practice and is easily moved from one place to another. Since the rifle rest is made of a unitary construction, there are no moving parts to create instability during use. Furthermore, once an elevational change has been made with the adjustment mechanism, the adjustment mechanism is also effective to make minor adjustments from side to side to ensure that the bottom edge portion of the rear portion remains in full contact with the surface on which it is resting.

Other objects, features, and advantages of the subject concept will become more apparent from the following detailed description of the preferred embodiments and certain modification thereof when taken together with the accompanying drawings.

DETAILED DESCRIPTION

Figure 1:
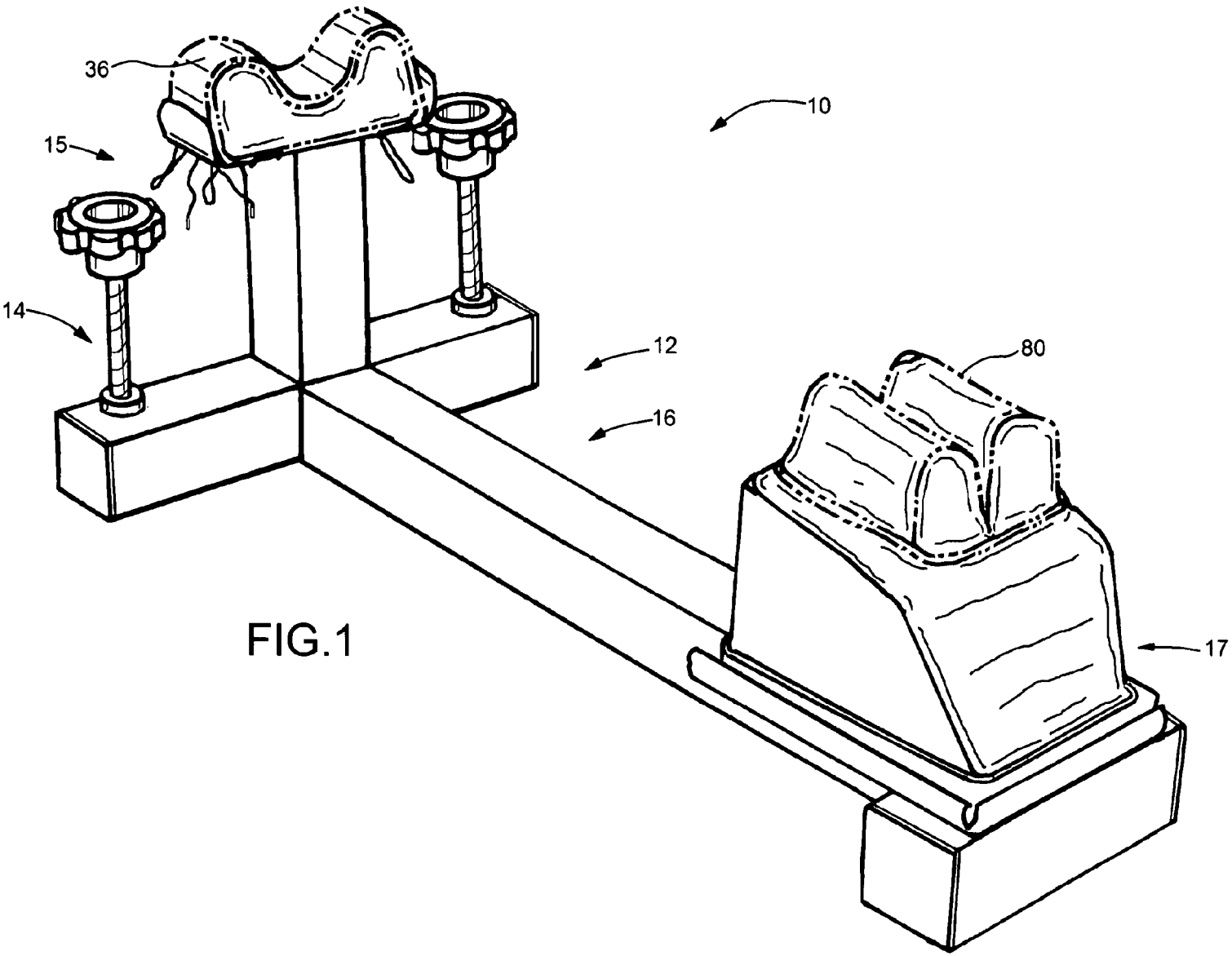
FIG. 1 illustrates a photographic perspective view of a working model of the subject concept with pre-purchased sand bags in place.

Referring to FIG. 1, a rifle rest 10 is disclosed having a unitary frame 12 and an adjustment mechanism 14 disposed thereon. The unitary frame 12 is composed of a front portion 15, a middle portion 16 and an end portion 17.

Figure 2:
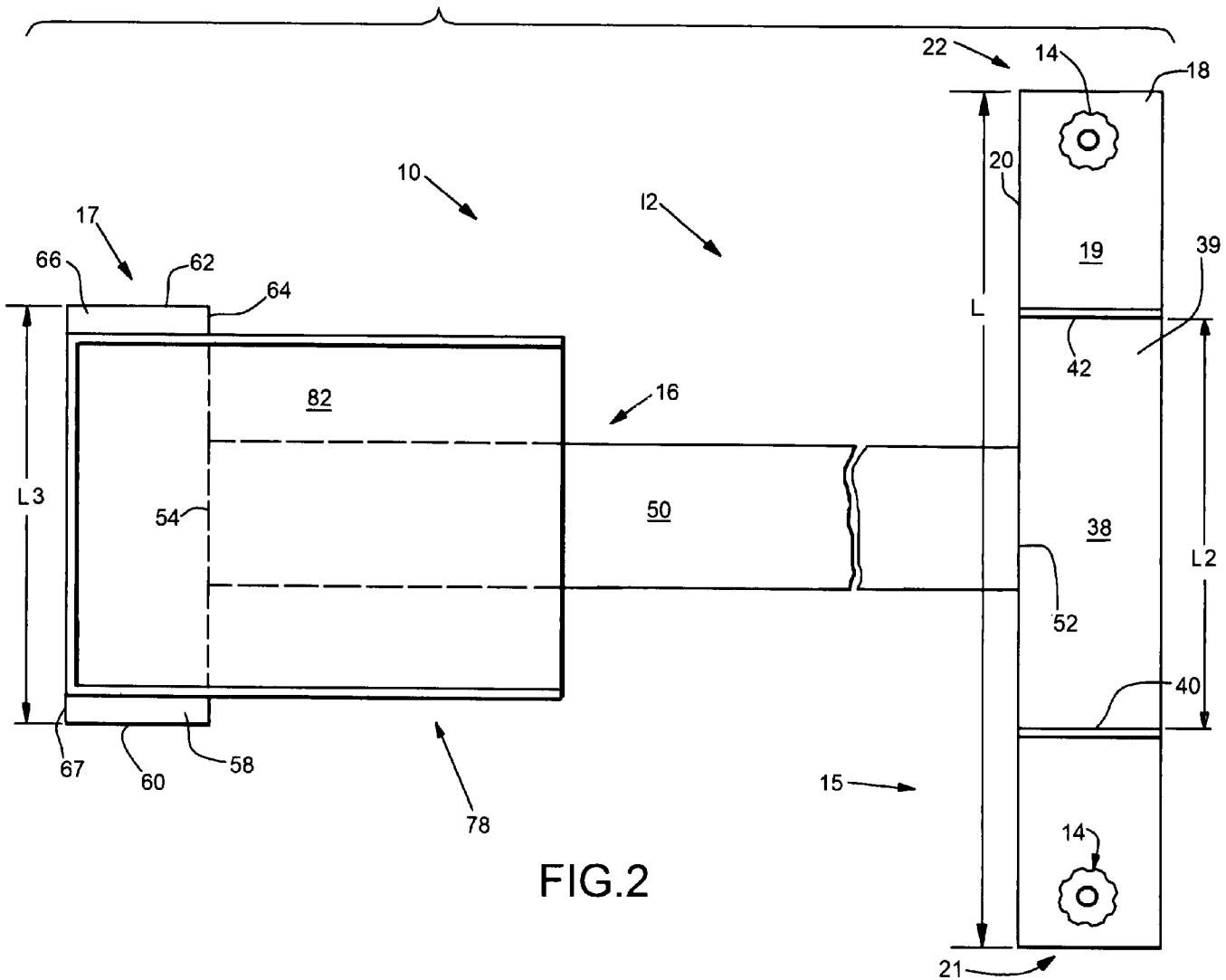
FIG. 2 is a pre-shortened top view of the rifle rest illustrated in FIG. 1.
Figure 3:
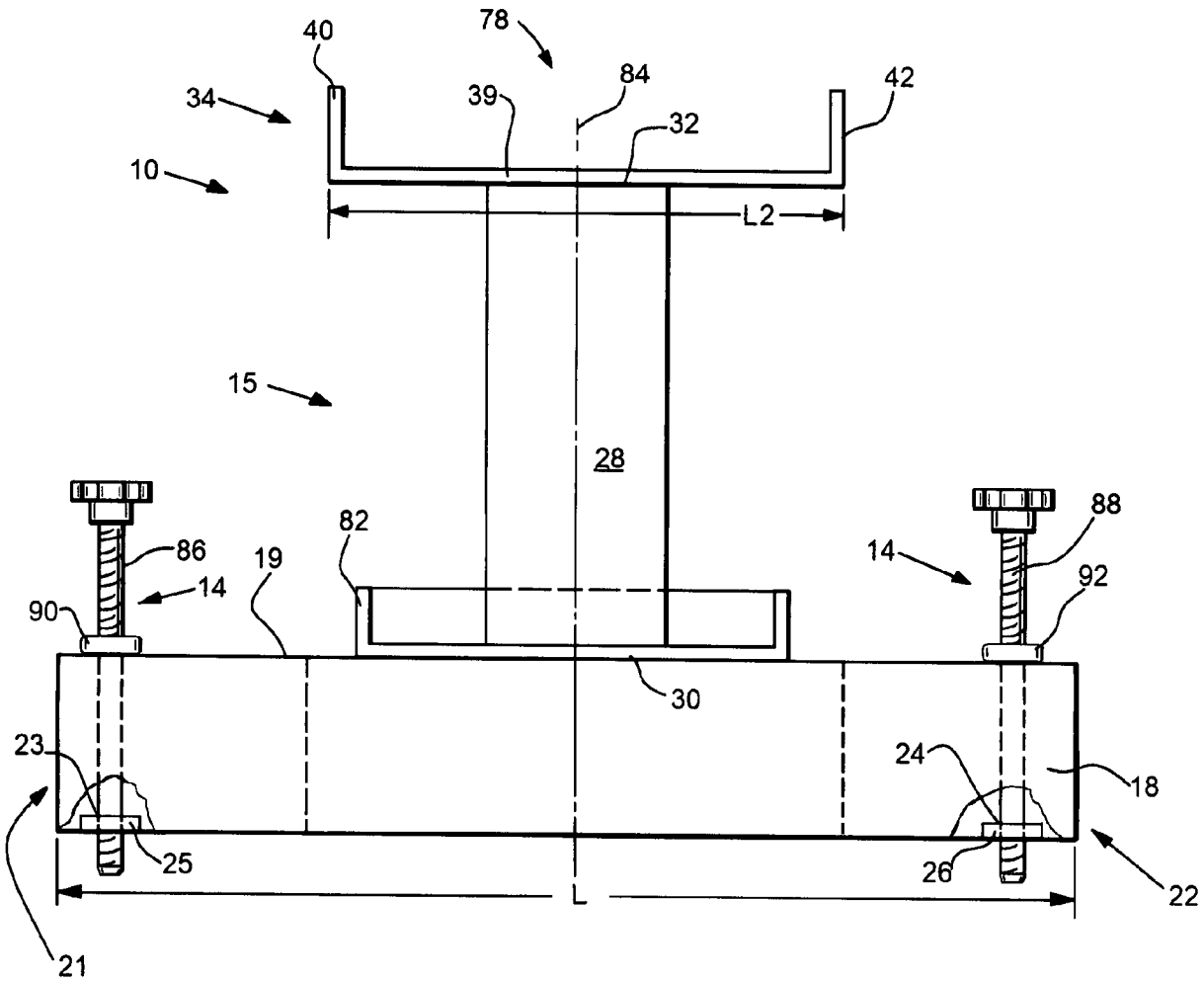
FIG. 3 is a front view of the rifle rest of FIG. 2.
Figure 4:
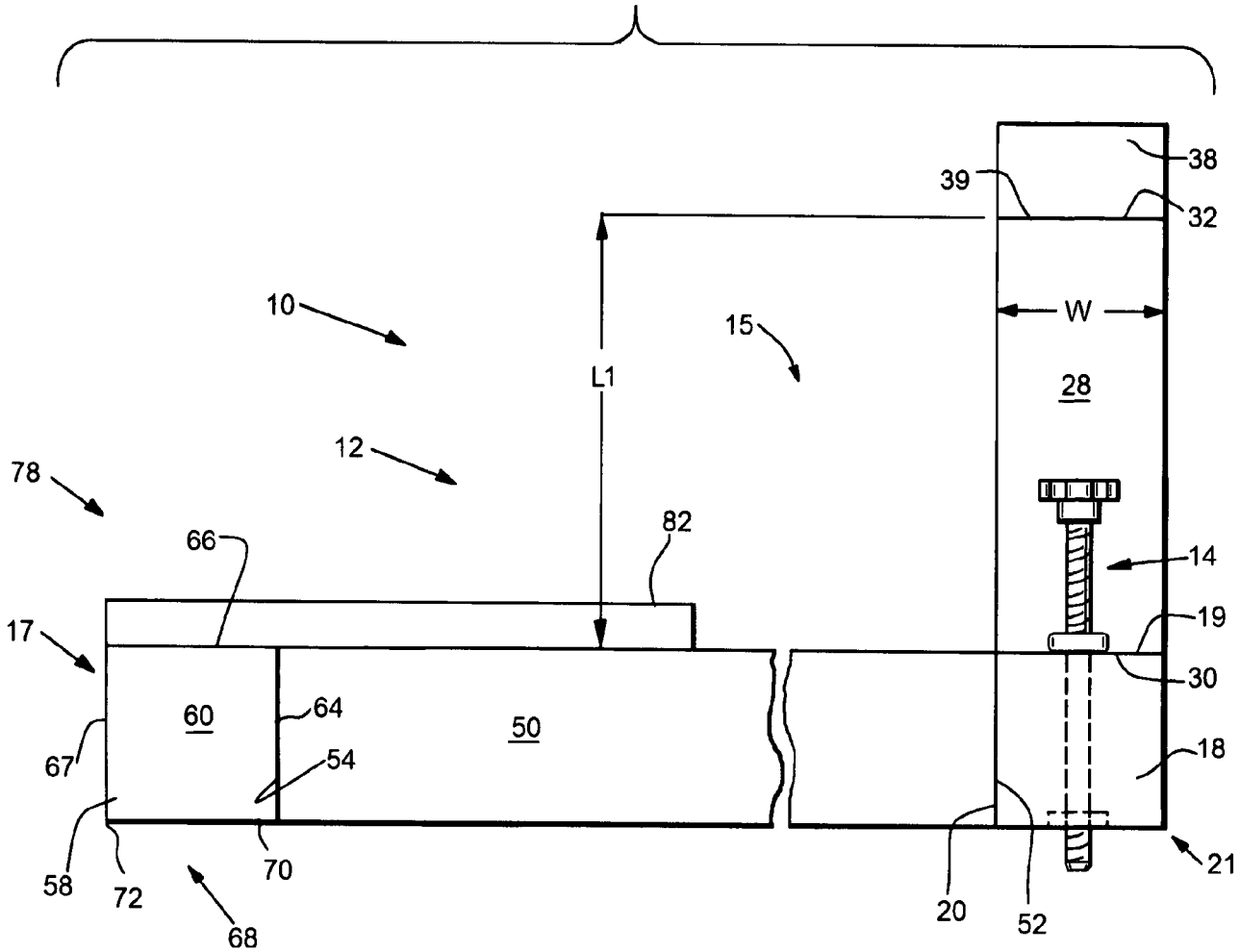
FIG. 4 is a pre-shortened side view of the rifle rest of FIG. 2.

Referring to FIGS. 2, 3 and 4 in conjunction with FIG. 1, the front portion 15 defines a first member 18 having a predetermined cross-sectional shape. In the subject arrangement, the predetermined cross-sectional shape is a box shape of a predetermined cross-sectional size. The first member 18 has first and second sides 19,20 and a predetermined length 'L'. In the subject arrangement the predetermined length 'L' is approximately 305 mm (12 inches).

The first member 18 has opposed first and second end portions 21,22 with a threaded passage 23 disposed in the first end portion 21 through a first square insert 25 and another threaded passage 24 disposed in the second end portion 22 through a second square insert 26. The first and second square inserts 25,26 are disposed generally adjacent the respective ends of the first member 18 and secured thereto by, for example, welding. It is recognized that the first and second square inserts could be secured to the first member 18 in various known ways without departing from the essence of the subject design.

A second member 28 has first and second ends 30,32 and the first end 30 thereof is solidly secured to the first member 18 by, for example, welding. The second member 28 has the same cross-sectional shape and size as that of the first member 18. The first end 30 of the second member 28 is secured to the first side 19 of the first member 18 at the mid-point thereof and the second member 28 extends generally perpendicular therefrom and in a generally vertical direction for a predetermined height 'L1'.

A bag receiving portion 34 is secured to the second end 32 of the second member 28 by, for example, welding and adapted to receive a pre-purchased sand bag 36 (shown in FIG. 1). The sand bag 36 is shown for illustrative purposes only, it does not constituent any part of the subject design. It is recognized that other sand bags could be used without departing from the essence of the subject design. The bag receiving portion 34 includes a u-shaped member 38 having a surface 39 and first and second flanges 40,42 formed thereon. The u-shaped member 38 has a width 'W' that is substantially the same size as the cross-sectional size and shape of the second member 28 and a length 'L2' that is generally one half of the length of the first member 18. The length 'L2' of the u-shaped member 38 is parallel with the length 'L' of the first member 18 and has the flanges 40,42 defined at opposite ends of the length 'L2'.

The middle portion 16 includes a third member 50 having first and second ends 52,54. The cross-sectional size and shape of the single member 50 of the middle section is substantially the same as the cross-section of first and second members 18,28 of the front portion 15. The first end 52 of the third member 50 is secured to the second side 20 of the first member 18 of the front portion 15 by, for example, welding and extends generally perpendicular therefrom in a generally horizontal direction when laid on a shooting surface (not shown).

The rear portion 17 includes a fourth member 58 having first and second ends 60,62, first, second, and third sides 64,66,67 and a bottom edge portion 68. The first side 64 of the fourth member 58 of the rear portion 17 is secured to the second end 54 of the single member 50 of the middle portion 16 by, for example, welding. The fourth member 58 herein has a cross-sectional size and shape substantially the same as that of the first and second members 18,28 of the front portion 15 and the third member 50 of the middle portion 16. The fourth member 58 of the rear portion 17 is oriented parallel to the orientation of the first member 18 of the front portion 15.

The fourth member 58 of the rear portion 17 has a predetermined length 'L3' that is generally one-half of the length 'L' of the first member 18 of the front portion 15. It is recognized that the ratio of the length 'L3' of the fourth member 58 of the rear portion 17 and the length 'L' of the first member 18 of the front portion 15 could be within the range of 1 to 6. However, a ratio of 1-4 could be used while a ratio of 1-2 is preferable.

The bottom edge portion 68 of the fourth member 58 of the rear portion 17 includes a bottom surface 70 of the fourth member 58 and an edge 72 defined by the bottom surface 70 and the third side 67 of the fourth member 58.

The rear portion 17 also includes a bag receiving portion 78 disposed on the second side 66 of the fourth member 58 thereof and being adapted to receive a pre-purchased sand bag. It is recognized that various other type of sand bags could be used without departing from the essence of the subject design. The bag receiving portion 78 includes a three sided rectangular pan 82 secured thereto by, for example, welding. The three sided rectangular pan 82 is disposed thereon so that the open side of the pan faces towards of the front portion 15 and is located centrally along a vertical reference plane 84 defined along the middle of the middle portion 16.

In the subject design, the three sided rectangular pan 82 is disposed on the second side 66 of the first member 58 of the rear portion 17 and the predetermined height 'L1' defined with respect to the position of the surface of the pan 82 and the position of the surface of u-shaped member 38 of the front portion 15. In the subject arrangement, the predetermined height 'L1' is approximately 127 mm (5 inches). It is recognized that the subject predetermine height could be varied depending on the size and shape of the respective sand bags 36,80 used. In the subject design, the predetermined height 'L1' has approximately a 1 to 2.4 size relationship relative to the predetermined width 'L'.

The adjustment mechanism 14 includes first and second adjusting screws 86,88 with associated first and second lock nuts 90,92. The first lock nut 90 is threaded onto the first adjusting screw 86 and the first adjusting screw 86 is threadably disposed within the threaded passage 23 of the first member 18 of the front portion 15. Likewise, the second lock nut 92 is threaded onto the second adjusting screw 88 and the second adjusting screw 88 is threadably disposed within the threaded passage 24 of the first member 18 of the front portion 15. The first and second adjusting screws 86,88 can be threaded up or down and locked in the chosen position with the respective lock nuts 90,92. It is recognized that other types of adjusting mechanisms could be used without departing from the essence of the subject design.

INDUSTRIAL APPLICABILITY

The subject rifle rest 10 provides a solid rest for a rifle during target practice and the like and does not readily move around during shooting of the rifle. It also provides the ability for the shooter to hold the rifle in a normal position while the rifle is cradled in the rifle rest. The unitary frame 12 acts to ensure that there is no flexing of the bag receiving portion 34 on the front portion 15 relative to the bag receiving portion 78 on the rear portion 17. Likewise, the second member 28 of the front portion 15 does not permit any relative movement between the first member 18 and the bag receiving portion 34 of the front portion 15.

Since the bag receiving portion 78 on the rear portion 17 is firmly secured to the fourth member 58 of the rear portion 17, no relative movement is permitted therebetween.

During use, the shooter positions his body adjacent the rifle rest 10 and positions the shank of the rifle on the sand bag 36 of the front portion 15 and rests the butt of the rifle against his shoulder and the rear bag 80 of the rear portion 17. If the target is not in sight of the rifle sights, the shooter raises or lowers the front portion 15 as needed by turning of the respective first and second adjustments screws 86,88. Once the front portion 15 of the rifle rest 10 has been properly adjusted with respect to the target, the shooter visually checks the position of the bottom edge portion 68 with respect to the surface that it is resting upon. If the bottom edge portion 68, which can either be the bottom surface 70 or the edge 72 defined by the bottom surface 70 and the third side 67, is not in contact with the surface that it rests upon across it's full width, the shooter adjusts the appropriate one of the adjusting screws 86,88 until full contact is achieved. This full contact of the bottom edge portion 68 works to ensure that the rifle rest 10 is stable and does not allow adverse movement during shooting of the rifle.

Other embodiments as well as certain variations and modifications of the embodiments herein shown and described will obviously occur to those skilled in the art upon becoming familiar with the underlying concept. It is to be understood, therefore, that the subject design may be practice otherwise than as specifically set forth above.

What is claimed is:

1. A rifle rest structure adapted to receive first and second sand bag for resting a rifle during target practice or the like, the rifle rest structure comprising:

a unitary frame having a front portion, a middle portion and a rear portion each rigidly attached to each other, the front portion has a first horizontal member of a predetermined length, a second vertical member having first and second ends and being rigidly attached at one end thereof to a central portion of the first horizontal member, and a first bag receiving portion rigidly attached to the other end of the second member spaced upwardly from the first member;

the middle portion of the unitary frame has a third member rigidly attached at one end thereof to the central portion of the first horizontal member and laying in a plane parallel with the first horizontal member;

the rear portion of the unitary frame has a fourth member of a predetermined length rigidly attached at the center of its horizontal length to the opposed end of the third member, the predetermined length of the fourth member has a length relationship with the predetermined length of the first horizontal member of the front portion in the range of one to six, and a second bag receiving portion rigidly attached to the top side of the fourth member at the center of its horizontal length; and an adjustment mechanism disposed on the front portion, the adjustment mechanism includes first and second adjusting screws, the first adjusting screw being vertically disposed generally adjacent one end of the first member of the front portion and the second adjusting screw being vertically disposed generally adjacent the other end of the first member of the front portion.

2. The rifle rest structure of claim 1, wherein the first bag receiving portion is rectangular in shape and has first and second flanges located on opposite ends thereof.

3. The rifle rest structure of claim 2, wherein the first and second flanges are located on opposite ends of the longest side of the rectangular shape and oriented parallel to the length of the first horizontal member of the front portion.

4. The rifle rest structure of claim 3, wherein the first and second adjusting mechanisms each has a respective locking nut disposed thereon and being operative to lock the respective adjusting screws relative to the first horizontal member of the front portion.

5. The rifle rest structure of claim 4, wherein a predetermined length is established between the flanges of the first bag receiving portion and the height between the respective surfaces of the first and second bag receiving portions is less than the predetermined length between the flanges of the rectangular first bag receiving portion.

6. The rifle rest structure of claim 1, wherein the fourth member has a bottom surface and an edge formed by the third side thereof disposed opposite to the side connected to the third member of the middle portion and the bottom surface, and includes a bottom edge portion established by the bottom surface and the edge formed by the bottom surface and the third side.

7. The rifle rest structure of claim 6, wherein the adjustment mechanism is operative to vary the elevational height of the first bag receiving portion and to adjust the rear portion to ensure that the bottom edge portion is in contact with its resting surface across its horizontal length.

8. The rifle rest structure of claim 1, wherein the length relationship between the fourth member of the rear portion and the first member of the front portion is in the range of one to four.

9. The rifle rest structure of claim 1, wherein the length relationship between the fourth member of the rear portion and the first member of the front portion is in the range of one to two.

10. The rifle rest structure of claim 6, wherein the shape and size of the first, second, third and fourth members are the same.

11. The rifle rest structure of claim 10, wherein the cross-sectional shape of the first, second, third and fourth members is square.

12. The rifle rest structure of claim 11, wherein the size of the square cross-sectional tubing is approximately 51 mm (2 inches).

13. The rifle rest structure of claim 1, wherein the second bag receiving portion is a three sided rectangular pan.

14. The rifle rest structure of claim 13, wherein the open side of the three sided rectangular pan is open towards the front portion.

15. The rifle rest structure of claim 1, wherein the first and second adjusting screws are respectively screw threadably mounted in the first member of the front portion.

16. The rifle rest structure of claim 1 wherein the first horizontal member and the fourth horizontal member are oriented parallel with each other.

* * * * *